2/11/86 XR 4,569,895

United States Patent [19]

Willett et al.

[11] Patent Number: 4,569,895

[45] Date of Patent: Feb. 11, 1986

[54] CHARGE TRANSFER MEDIA AND PROCESS FOR MAKING THEREOF

[75] Inventors: Stephen J. Willett, St. Paul; Hsin H. Chou, Maplewood, both of Minn.; Carol E. Hendrickson; William A. Hendrickson, both of St. Joseph Township, St. Croix County, Wis.

[73] Assignee: Minnesota Mining and Manufacturing Company, St. Paul, Minn.

[21] Appl. No.: 666,490

[22] Filed: Oct. 30, 1984

[51] Int. Cl.[4] ..... G03G 5/14

[52] U.S. Cl. ..... 430/70; 430/60; 430/75; 430/83; 430/84; 430/130

[58] Field of Search ..... 430/66, 130, 127, 70, 430/75, 83, 84

[56] References Cited

U.S. PATENT DOCUMENTS

| | | | |
|---|---|---|---|
| 3,018,189 | 1/1962 | Traver . | |
| 4,064,030 | 12/1977 | Nakai et al. . | |
| 4,170,662 | 10/1979 | Weiss et al. | 427/38 |
| 4,263,359 | 4/1981 | Kitts . | |
| 4,372,807 | 2/1983 | Vossen et al. . | |
| 4,373,016 | 2/1983 | Kings et al. . | |
| 4,454,186 | 6/1984 | Hendrickson et al. . | |
| 4,481,234 | 11/1984 | Kolpe et al. | 430/66 |

OTHER PUBLICATIONS

C. B. Kuke and T. J. Fabish, *J. Appl. Phys.* 49, 315 (1978).

D. A. Hays, *J. Chem. Phys.* 61, 1455 (1974).

S. Kittaka and Y. Murata, *Jap. J. of App. Phys.* 18, 295 (1979).

J. Lowell, J. Lowell, *J. Phys. D: Appl. Phys.* 10, 65 (1977).

J. Lowell, *J. Phys. D: Appl. Phys.* 12, 2217 (1979).

J. Lowell, *J. Phys. D: Appl. Phys.* 14, 1513 (1981).

J. Lowell and A. C. Rose-Innes, *Advances in Physics* 29, 947 (1980).

*Primary Examiner*—John L. Goodrow

*Attorney, Agent, or Firm*—Donald M. Sell; James A. Smith; David L. Weinstein

[57] ABSTRACT

An article having improved electrostatic charge transfer properties. The improvement in charge transfer properties results from subjecting a layer of photoconductive-insulative material or dielectric material on the charge donor or a layer of dielectric material on the charge receptor, or both layers, to plasma treatment process to provide an oxygen-enriched surface to the photoconductive-insulative layer and/or the dielectric layer.

12 Claims, No Drawings

CHARGE TRANSFER MEDIA AND PROCESS FOR MAKING THEREOF

BACKGROUND OF THE INVENTION

The present invention relates to novel electrostatic charge transfer media and a method for preparing said media. Plasma treatment (generated by radio frequency R.F., alternating current A.C., microwave, or direct current D.C.) of suitable polymers produces a modified polymer surface that provides improved transfer of electrostatic charge from a donor surface to a receptor surface.

Over the past several decades, organic polymers have been extensively utilized to produce articles such as films, sheets, coatings, tapes, or cloths, and are particularly desirable because of their superior physical and chemical properties in such areas as electrical characteristics, thermal characteristics, chemical resistance, shatter resistance andd flexiblity. However, because their surface is inert and insulative, electrostatic charge transfer to such a surface is inefficient.

The transfer of electrostatic images from one surface to another, for example, from an electrophotographic plate to a dielectric surface, provides a method of electrostatic printing or copying wherein the latent electrostatic charge pattern is not directly developed to visible form on the electrophotographic plate or drum. This eliminates the need for cleaning the electrophotographic plate or drum, thereby eliminating the need for cleaning devices, and consequently improving the life of plates and drums and reducing the maintenance requirements. An added advantage of the charge transfer process is that the transferred electrostatic charge image is stable (no dark decay as seen on electrophotographic substrates) and may be developed off-line up to 4 days after transfer. Processes known in the prior art for the transfer of electrostatic images (an art at times referred to by the acronym, TESI) have found practical applications in commercial electrophotographic or electrostatic printing only for low resolution images.

In electrophotography or electrostatic printing, the prior art techniques for accomplishing charge transfer from one surface to another involves either: (1) conduction of electric charges across an air gap, or (2) direct charge transfer if the air gap is eliminated. While the air breakdown charge transfer technique is simple, it does not provide high resolution (less than 80 line pairs per millimeter (lp/mm) can be achieved) or continuous tone gray scale reproduction. Finally, this technique also requires the donor surface to sustain high surface potentials to insure air breakdown. The presently known techniques for direct charge transfer require a very smooth surface, a transfer liquid interfacing the donor and receptor films, very high pressures to eliminate the air gap, or a surface provided with a multitude of conductivity sites, as described in U.S. Pat. No. 4,454,186. Even though high resolution exceeding 200 lp/mm charge transfer has been claimed, the transfer speed is too low, and the charge transfer efficiency is too low for certain types of imaging procedures, particularly when the transfer of charge is required in a short time interval, e.g., less than 0.1 sec. In many commercial applications, for example, duplication of customers' checks by banks, transfer of charge must be accomplished within an extremely short time interval. Accordingly, there remains a need for a simple means of making high resolution charge transfer images with gray scale fidelity, high transfer speed, and high transfer efficiency.

SUMMARY OF THE INVENTION

In one aspect, the invention involves novel electrostatic charge transfer media, i.e. charge donors and charge receptors. The charge donor comprises a conductive support layer and overlying the conductive support layer, a layer of either photoconductive-insulative material or dielectric material. The major surface of the photoconductive-insulative layer not in contact with the conductive support layer contains a higher content of oxygen than does the material constituting the bulk of the photoconductive-insulative layer or dielectric layer and has a surface roughness no greater than 0.01 micrometer. The charge receptor comprises a conductive support layer and overlying the conductive support layer, a layer of dielectric material. The major surface of the dielectric layer that is not in contact with the conductive support layer contains a higher content of oxygen than does the material constituting the bulk of the dielectric layer and has a surface roughness no greater than 0.01 micrometer.

In another aspect, the present invention involves a method of treating the aforementioned major surface of the dielectric layer or photoconductive-insulative layer of the charge donor in order to make the treated charge donor more efficient for transferring an imagewise distribution of charge to a charge receptor. The same method can also be used to treat the aforementioned major surface of the dielectric layer of the charge receptor in order to make the treated charge receptor more efficient for receiving an imagewise distribution of charge from a charge donor.

The method of this invention comprises treating the surface of polymeric sheets with gas plasma, e.g., oxygen, argon, under such conditions that the treated surface will have a roughness no greater than 0.01 micrometer, e.g., at about 0.1 to about 10 micrometers pressure for about 0.1 to about 8 minutes.

The resultant important performance improvement of the articles of this invention resides in the increased electrostatic charge transfer efficiency at high transfer speeds when at least one of the transfer surfaces of the charge donor or charge receptor has been treated according to the method of the present invention. An additional, and equally important, improvement is that the efficient charge transfer can be accomplished without an electrical bias; that is, the conductivity planes of the charge receptor and charge donor, respectively, need only be brought to the same electrical potential, which preferably is ground potential. With charge transfer media treated by the method of this invention, the transfer of charge can be accomplished with high efficiency (in excess of 50%), with high resolution (in excess of 150 line pairs/mm), and at much higher speeds (in excess of 450 frames/min) than has previously been possible.

DETAILED DESCRIPTION

Both charge donors and charge receptors comprise a conductive support layer. The conductive support layer for either the donor or receptor can comprise a single layer of conductive material so long as this layer provides sufficient stability to the donor or receptor for the intended purpose, i.e. charge transfer. Preferably, the conductive support layer comprises both a support to provide stability to the donor or receptor and a conductive layer applied to at least one major surface of the support. Materials suitable for a support for a charge receptor or a charge donor include paper, glass, ceramics, and polymers. Of particular interest are substantially transparent, flexible materials such as polymers having a thickness of between about 5 and 250 micrometers (μm). As used herein, the term "substantially transparent" means greater than 60% transmission of visible light. Suitable polymers for the support for the media of this invention include polycarbonates, polyesters, polyvinylchlorides, cellulose acetate, cellulose butyrate, polyethylenes, polypropylenes, polyimides, polystyrenes, esters of polyarcylic acid, esters of polymethacrylic acid, and combinations, i.e., blends of copolymers, of these.

Materials suitable for a conductive layer for a charge receptor or a charge donor have a surface resistivity of $1\times10^9$ ohms/square or less. For some applications, it is preferred that the conductive materials be substantially transparent. Representative examples of suitable conductive materials for the media of this invention include indium tin oxide, aluminum, chromium, copper, nickel, copper iodide, and conductive polymers.

Suitable electrostatic photoconductive-insulative materials for the charge donor of this inventioon include inorganic materials such as selenium, selenium-tellurium, cadmium sulfide, zinc oxide, and antimony sulfide. The materials may be coated as a thin film on a conductive backing or alternatively may be combined in a suitable binder and coated on a conductive electrode. Other suitable electrostatic photoconductives-insulative materials include organic photoconductor such as phthalocyanine pigments and polyvinyl carbazoles, with or without binders and additives that can extend their range of spectral sensitivity. These are well known in the art. For example, U.S. Pat. No. 3,877,935 illustrates the use of polynuclear quinone pigments in a binder as a photoconductive layer; U.S. Pat. No. 3,824,099 demonstrates the use of squaric acid methine and triaryl pyrazoline compounds as an electrophotographic charge transport layer; U.S. Pat. No. 3,037,861 discloses the use of poly-N-vinyl-carbazole as a photoconductive-insulative layer.

The term photoconductive-insulative layer is defined as including both single layers of materials (e.g., a single photoconductive material such as an organic or inorganic photoconductive material, or a charge generating material dispersed in a charge transport binding medium) and multiple layers (such as a layer of a charge generating material covered by a charge transport layer).

Materials suitable for the dielectric layer of the charge donor or charge receptor are those materials with surface resistivities of greater than $1\times10^{14}$ ohms per square. Representative examples of suitable dielectric materials for the charge donor or charge receptor of this invention include polyesters, polycarbonates, polyvinylacetals, polyvinylchlorides, polyvinylidenechlorides, polyvinylfluorides, polyvinylacetates, polystyrenes, polyamides, polyethers, polyolefins, polyacrylates, polymethacrylates, and combinations, i.e. blends and copolymers, thereof. The thickness of the dielectric layer of the charge receptor is a function of the dielectric strength of the layer material (i.e., the dielectric layer of the charge receptor must be of sufficient thickness to maintain the desired surface potential without dielectric breakdown), the dielectric constant of the dielectric layer of the charge receptor and dielectric constant of the photoconductive-insulative layer or dielectric layer of the chage donor, and the thickness of the photoconductive-conductive layer or dielectric layer of the charge donor. Optimally, dielectric coatings must be thick enough to avoid dielectric breakdown and thin enough to provide maximum charge transfer efficiency ($\eta$), which is defined below:

$$\eta = \frac{C_2}{C_2 + C_1} = \frac{\epsilon_2 D_1}{\epsilon_2 D_1 + \epsilon_1 D_2}$$

where $\eta$ = maximum theoretical charge transfer efficiency based on the capacitor model of charge transfer, $C_1$ = capacitance of the dielectric or photoconductive-insulative layer of the charge donor, $C_2$ = capacitance of the dielectric layer of the charge receptor, $\epsilon_1$ = dielectric constant of the dielectric or photoconductive-insulative layer of the charge donor, $\epsilon_2$ = dielectric constant of the dielectric layer of the charge receptor, $D_1$ = thickness of the dielectric or photoconductive-insulative layer of the charge donor, $D_2$ = thickness of the dielectric layer of the charge receptor.

The surface of the dielectric layer or photoconductive-insulative layer of the charge donor and the surface of the dielectric layer of the charge receptor of this invention can be characterized as containing more oxygen than the bulk of the photoconductive-insulative layer or dielectric layer. The difference in oxygen content between the surface and the bulk of the aforementioned layers should preferably be at least 4%. In other words, if the bulk contains n% oxygen, e.g., 12%, the surface should preferably contain at least (n+4)% oxygen, i.e., 16%. The oxygen content of the surface can be measured by means of a surface analytical technique called X-ray Photoelectron Spectroscopy (XPS), while the oxygen content of the bulk can be measured by means of conventional combustion analysis for carbon, hydrogen, and nitrogen (CHN). As used herein, the term "surface" when used in the phrases "surface of the photoconductive-insulative layer" and "surface of the dielectric layer" means the major surface of the dielectric or photoconductive-insulative layer not in contact with the conductive support layer, said major surface having a depth of about 10 nanometers. The term "%" or "percent" when used to refer to percent (%) of oxygen, carbon, nitrogen, or other element in the surface or bulk of the photoconductive-insulative layer or dielectric layer means atomic percent.

It is also important that the oxygen-enriched major surface of the photoconductive-insulative layer and dielectric layer have a surface roughness no greater than 0.01 micrometer. As used herein, the term "surface roughness" means the mean value of roughness heights on the surface, which can be measured by the use of a scanning electron microscope, interference microscope (multiple beam interferometry, differential interference contrast method), stylus-type roughness tester or Topografiner (The Review of Scientific Instruments, Vol. 43, page 999–1011 (1972), American Institute of Physics). The surface roughness on the surface of a layer provided can be measured, for example, from roughness of interference fringes, shift of interference fringes, degree of change of interference patterns, etc. in the case of using a multiple interference microscope or from pattern of surface roughness, etc., in the case of using stylus-type roughness tester. A plasma treated surface wherein the surface roughness exceeds 0.01 micrometer provides inferior levels of resolution.

Although the charge donor and charge receptor of this invention do not require a multitude of metal or metal oxide conductivity sites, such sites can be present on the dielectric layer of the charge receptor or on the dielectric layer or photoconductive-insulative layer of the charge donor in order to modify the charge transfer characteristics of the charge receptor or charge donor.

The treated surfaces of the photoconductive-insulative layer and the dielectric layer can be produced by plasma exposure of the layer by any of the processes known in the art such as corona discharge, glow discharge, sputter etching, arc discharge using R.F., A.C., D.C., or microwave power sources, or flame treatment. The treatment can be effected with an inert gas, such as argon, or a reactive gas, such as oxygen. Gases such as nitrogen, air, $CO_2$, CO, $NH_3$, NO, $N_2O_4$, Xe, He, Ne, Kr and mixtures thereof are also useful in the practice of the present invention.

The process of the present invention will produce, by sputter-etching with an oxygen plasma, a polymer surface with 50–85% carbon and 15–50% oxygen content in the surface. If nitrogen is used as a plasma, or a starting polymer with nitrogen incorporated therein is used, a 1–15% nitrogen content will also be present on the surface. If sputtering gases such as argon are used, both oxygen and nitrogen will be incorporated on the surface (due to the contaminants in the gas, presence of oxygen in the original polymer, and reaction of the active surface with atmospheric gases). The preferred ratios for any plasma-treated surface are 70–85% carbon, 10–30% oxygen and 0–10% nitrogen and the surface will contain four distinct types of carbon species (designated herein $C_a$, $C_c$, $C_i$, and $C_j$ and described in TABLE I below). It is to be understood that these specific types of carbon species are in or attached to a polymer backbone. Determination of polymer oxidation levels and carbon species in a polymer surface can most readily be accomplished by X-ray Photoelectron Spectroscopy (XPS) or Electron Spectroscopy for Chemical Analysis (ESCA) (see for example the references "Polymer Surfaces", ed. D. T. Clark et al., John Wiley & Sons, NY (1978) and "Photon, Electron, and Ion Probes of Polymer Structure and Properties", ed. D. W. Dwight et al., ACS Symposium Series 162, American Chemical Society, Washington, D.C. (1981)). Determination of surface atomic ratios and chemical makeup of the surface of a sample by the XPS method of analysis is accomplished by bombarding the sample with monochromatic soft X-rays and analyzing the intensity and energies of the emitted core level electrons. These types of carbon can be designated $C_a$, $C_b$, $C_c$, $C_d$, $C_e$, $C_f$, $C_g$, and $C_h$ and refer to chemical functionalities shown in TABLE I below.

TABLE I

| XPS designation | XPS Carbon Types: Carbon types | X | Representative examples |
|---|---|---|---|
| $C_a$ | 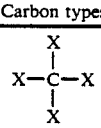 | C,H | cyclohexane, 2-pentyne |

TABLE I-continued

| XPS designation | XPS Carbon Types: Carbon types | X | Representative examples |
|---|---|---|---|
| $C_b$ | 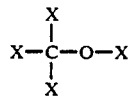 | C,H | methanol, dimethylether |
| $C_c$ | 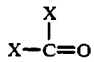 | C,H | acetone, formaldehyde |
| $C_d$ | 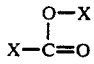 | C,H | acid or ester carbons in dibutylphthalate |
| $C_e$ | 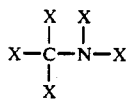 | C,H | methylamine |
| $C_f$ | 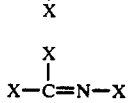 | C,H | unsaturatedcarbon in acetoxime |
| $C_g$ | 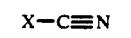 | C | acetonitrile |
| $C_h$ | 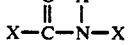 | C,H | carbons bonded to both O and N in phthalimide |
| $C_i$ | combination of one or more of $C_b$, $C_e$, $C_f$, and $C_g$ | | |
| $C_j$ | combination of one or more of $C_d$, $C_h$ | | |

In all cases four peaks corresponding to $C_a$, $C_i$, $C_c$, and $C_j$ exist for the treated polymeric films.

It must be pointed out that direct observation of carbons $C_a$ to $C_j$ in a single spectrum may be difficult due to overlapping of the signals and therefore the data analysis is done by computer.

Distribution of relative amounts of $C_a$, $C_c$, $C_i$, $C_j$ may be quite broad with each peak being at least 0.2% of the total carbon region of the spectra and not more than 75%. Preferably $C_a$ is in the range of 20–70%, $C_i$ is in the range of 10–40%, $C_c$ is in the range of 2–60%, and $C_j$ is in the range 3–25%. More preferably $C_a$ is in the range of 40–70%, $C_i$ is in the range of 15–30%, $C_c$ is in the range 5–20%, and $C_j$ is in the range of 4–20%.

X-ray Photoelectron Spectroscopy results for various polymeric film surfaces and various plasma treatments are shown in Table II below where different carbon types observed on the surface and their relative contributions as a function of plasma treatment are given.

TABLE II

Percent Surface Carbon Species on Polymeric Films with Various Plasma Treatments

| Polymer | Method of Treatment | Percent $C_x$: $C_a$ | $C_i$ | $C_c$ | $C_j$ |
|---|---|---|---|---|---|
| Polystyrene | a | 100 | 0 | 0 | 0 |
| Polystyrene | b | 63.2 | 23.9 | 8.4 | 4.9 |
| Polyvinylbutyral | a | 60.9 | 24.1 | 15.0 | 0 |
| Polyvinylbutyral | b | 53.9 | 25.0 | 14.3 | 6.8 |
| Polyester* | a | 63.6 | 19.8 | 0 | 16.6 |
| Polyester* | b | 56.1 | 19.9 | 8.7 | 15.3 |
| Polyester* | c | 59.3 | 19.5 | 6.4 | 14.7 |
| Polyester* | d | 55.7 | 22.2 | 10.8 | 11.3 |
| Polyester** | a | 65.6 | 21.4 | 0 | 13.0 |
| Polyester** | b | 55.8 | 26.0 | 11.9 | 6.2 |
| Poly(methylene oxide) | a | 18.2 | 11.5 | 70.3 | 0 |

TABLE II-continued

Percent Surface Carbon Species on Polymeric Films with Various Plasma Treatments

| Polymer | Method of Treatment | Percent $C_x$ | | | |
|---|---|---|---|---|---|
| | | $C_a$ | $C_i$ | $C_c$ | $C_j$ |
| Poly(methylene oxide) | b | 20.4 | 14.8 | 53.7 | 11.0 |
| Poly(methylene oxide) | c | 34.7 | 23.1 | 31.0 | 11.2 |
| Poly(methylene oxide) | d | 38.5 | 20.2 | 32.3 | 8.8 |
| Nylon 66 | a | 50.0 | 34.8 | 0 | 15.2 |
| Nylon 66 | b | 48.2 | 26.5 | 5.3 | 19.8 |
| Nylon 66 | c | 54.1 | 27.2 | 9.1 | 9.6 |
| Nylon 66 | d | 53.1 | 21.0 | 8.2 | 17.8 |
| Polyethylene | a | 100 | 0 | 0 | 0 |
| Polyethylene | b | 44.6 | 27.3 | 12.3 | 15.9 |
| Polyethylene | c | 54.7 | 23.5 | 11.4 | 10.4 |
| Polyethylene | d | 58.4 | 27.6 | 8.1 | 5.9 |
| Polypropylene | a | 100 | 0 | 0 | 0 |
| Polypropylene | b | 56.8 | 20.0 | 14.2 | 8.9 |
| Polypropylene | c | 56.0 | 25.1 | 8.5 | 10.4 |
| Polypropylene | d | 53.3 | 27.6 | 4.4 | 7.7 |
| Polyester* | e | 59.3 | 25.8 | 6.2 | 8.7 |
| Polystyrene | e | 71.0 | 16.3 | 10.0 | 2.8 |
| Polyvinylbutyral | e | 55.3 | 23.9 | 14.2 | 6.6 |
| Poly(α-methylstyrene) | a | 100 | 0 | 0 | 0 |
| Poly(α-methylstyrene) | e | 73.9 | 18.6 | 2.6 | 4.9 |
| Poly(α-methylstyrene) | b | 64.1 | 21.6 | 8.9 | 5.4 |

*Vitel ® PE 200, Goodyear Tire and Rubber Co.
**Vitel ® PE 222, Goodyear Tire and Rubber Co.
[a]untreated
[b]Oxygen plasma etch
[c]Argon plasma etch
[d]Nitrogen plasma etch
[e]Oxygen glow discharge Plasma treatment to obtain the above surfaces can be conducted using existing sputtering or glow discharge apparatus. No modifications of existing apparatus is essential in practicing this process, but care must of course be exercised that the appropriate gas pressure, gas throughput, exposure time, and ionizing voltage be used to treat the charge receptor or charge donor (e.g., photoconductive-insulative material) to maintain not only the high transfer efficiency and the high resolution, but also the high transfer speed. With regard to these requirements it is important that the surface being subjected to plasma treatment be treated under such conditions that the treated surface have a roughness no greater than 0.01 micrometer. A greater level of roughness would adversely affect resolution.

The effectiveness of the process for making charge receptive surfaces can be determined by the following test. A control electrophotographic sheet (EK SO-102) which comprises a mixture of (1) a polyester binder derived from terephthalic acid, ethylene glycol, and 2,2-bis(4-hydroxyethoxyphenyl)propane, (2) a charge transport material comprising bis(4-diethylamino-2-methylphenyl)methane, and (3) a spectral sensitizing dye absorbing in the green and red wavelength regions in combination with a photographic supersensitizer is charged to 450 volts and the charged surface is contacted by the treated surface of the sheet prepared by the present invention. If at least 15% of the charge on the sheet is transferred within 0.1 second of contact, and if high resolution is maintained (i.e., resolution greater than 120 line pairs/mm) after development with a suitable liuid toner, the material selected is satisfactory.

The use of plasma treatment on at least one charge transfer surface dramatically improves the speed and efficiency during imaging processes. Charge transfer in excess of 40% is readily obtainable and it is not unusual to obtain charge transfer efficiencies approaching the theoretical maximum. For a donor having a photoconductive-insulative surface made of EK SO-102 used with a charge receptor having a 3 μm thick polyester (Vitel ® PE 200) dielectric layer, $\eta$ is 61%. In high speed applications with very short contact times for charge transfer, the plasma treated surfaces of the present invention show little dependence of transfer efficiency on contact time when contacted for at least $1\times10^{-3}$ seconds. Consequently, plasma treated surfaces are useful in high speed imaging applications.

In addition to using the plasma treatment on only the charge donor or on only the charge receptor, the plasma treatment can be used on both donor and receptor to further improve the charge transfer efficiency and speed of charge transfer.

A suitable toner for development of the transferred electrostatic charge is composed as shown in Table III.

TABLE III

| Raw Material | Proportions by weight | Percent of Composition by weight |
|---|---|---|
| Carbon black [a] | 2 | 10.5 |
| Polyethylene [b] | 1 | 5.3 |
| Succinimide [c] | 4 | 21.0 |
| Isoparaffinic hydrocarbon [d] | 12 | 63.2 |
| | | 100.0 |

[a]Tintacarb 300 Carbon Black manufactured by Australian Carbon Black, Altona, Victoria, Australia
[b]Polyethylene AC-6, low molecular weight polyethylene manufactured by Allied Chemicals, New York
[c]OLOA 1200, an oil soluble succinimide manufactured by the Chevron Chemical Company, San Francisco, California
[d]Isopar M, Isoparaffinic hydrocarbon, high boiling point, manufactured by Exxon Corp.

The toner components were mixed according to the following sequence:

1. The carbon black was weighed and added to a ball jar.

2. The polyethylene, succinimide, and vehicle were weighed into a common container, preferably a glass beaker, and the mixture heated on a hotplate with stirring until solution occurred. A temperature of 100° C.±10° C. was sufficient to melt the polyethylene and a clear brown solution was obtained.

3. The solution from (2) was allowed to cool slowly to ambient temperature, preferably around 20° C., in an undisturbed area. The wax precipitated upon cooling, and the cool opaque brown slurry so formed was added to the ball jar.

4. The ball jar was sealed, and rotated at 70–75 rpm for 120 hours. This milling time was for a jar of 2600 mL nominal capacity, with an internal diameter of 18 cm. A jar of these dimensions would take total charge of 475 g of raw materials, in the proportions stated in Table I.

5. Upon completion of the milling time, the jar was emptied and the contents placed in a suitable capacity container to form the final toner concentrate designated MNB-2.

In all of the examples which follow, except where noted:

Resolution values were obtained by corona charging the photoconductor to 800–900 V, exposing it to a test image, and bringing the surface in contact with a dielectric at approximately 1200 psi. The aluminum electrodes underlying the dielectric films were both grounded. The charge image on the dielectric was developed with liquid toner.

Efficiency values were obtained by corona charging the photoconductor to 0–500 V, exposing it to a test image, and bringing the surface in contact with a dielectric at approximately 1200 psi. The low voltage precluded air breakdown transfer mode. Final voltages on both the photoconductor and charge receptor surfaces were measured.

Objects and advantages of this invention are further illustrated by the following examples, but the particular materials and amounts thereof recited in these examples, as well as the conditions and details, should not be construed to unduly limit this invention.

EXAMPLE I

This example demonstrates the high transfer efficiency and resolution obtained by using plasma treated films.

Charge receptors were fabricated by selecting as a substrate a 15 cm long × 10 cm wide sample of 75 μm thick polyester. Upon the substrates were vacuum vapor deposited (i.e., thermally evaporated) an aluminum metal layer which had a white light transparency of about 60 percent and a resistance of about 90 ohms/square. Subsequently, a dielectric layer was hand coated from a 15 percent by weight polyester (Vitel® PE 200 from Goodyear Tire and Rubber Co., Ohio, Chemical Division)/85 percent by weight dichloroethane solution using a #20 Mayer bar which resulted in a wet thickness of about 46 μm and dried thickness of about 5 μm.

Further processing was conducted in a Veeco® Model 776 radio frequency diode sputtering apparatus operating at a frequency of 13.56 MHz, modified to include a variable impedence matching network. The apparatus included two substantially parallel shielded circular aluminum electrodes, one of which (cathode) was 40 cm in diameter and the other (anode) was 20 cm in diameter with a 6.25 cm gap between them. The electrodes were housed in a glass jar provided with R.F. shielding. The bell jar was evacuatable and the cathode (driven electrode) and anode (floating electrode) were cooled by circulating water.

To eliminate the possibility of metal deposition during the plasma treatment, 75 μm thick sheets of polyester were used to cover the driven and floating electrodes.

The foregoing composite sheet was centrally placed on the polyester cover on the driven or floating electrode with the dielectric layer facing the opposite electrode.

The system was then evacuated to about $1\times10^{-5}$ torr, and oxygen gas introduced through a needle valve. An equilibrium pressure in the range of $5\times10^{-4}$ torr to $8\times10^{-4}$ torr was maintained as oxygen was continuously introduced and pumped through the system.

R.F. energy source was capacitively coupled to the cathode, initiating a plasma. The energy input was increased until a cathode power density of 0.15 watts/cm$^2$ was reached, thus causing plasma bombardment of the composite and hence oxidation of the surface.

Plasma treatment was continued for 34 seconds immediately after which the bell-jar was opened to the atmosphere. A charge receptor surface was thus formed consisting of 29% oxygen and 71% carbon which was apportioned between the four previously defined species $C_a$, $C_i$, $C_c$, $C_j$ in the relative amounts 57.0%, 25.6%, 8.7% and 8.7% respectively.

A charge donor material, a composite structure consisting of a 75 μm thick polyester layer covered by a conductive copper iodide layer, which in turn was covered by an 8.5 μm thick organic photoconductive-insulative layer (EK SO-102), was treated in a similar manner.

The charge donor was then charged to +900 volts using a corona source and image-wise exposed to generate a high resolution electrostatic charge pattern. With the electrostatic charge pattern on its surface, the charge donor grounded via the conductive backing and situated on a grounded aluminum platform was brought into intimate contact with the plasma treated charge receptor. The aluminum platform provided electrical contact to the back electrode for the charge receptor as well as providing the moderate pressure needed for good contact. Measurement of the surface potential on the charge receptor after separation from the charge donor indicated that about 57% of the electrostatic charge was transferred.

The transferred electrostatic charge was developed with the toner described in Table I. The resolution of the developed image was about 130 lp/mm.

EXAMPLE II

This example demonstrates the effect on transfer efficiency and development resolution when either one or both of the charge donor or charge receptor are not subjected to plasma treatment.

(a) a charge receptor and a charge donor were prepared as in Example I; however, no plasma treatment was given to either of the articles. When the image-wise exposure, electrostatic charge image transfer, and transferred charge development were carried out as in Example I, only about 9% of the electrostatic charge transferred, and the resolution of the developed image was only about 100 lp/mm.

(b) On a second pair of similarly prepared charge donor and charge receptor samples, the charge donor was treated with oxygen plasma in the same manner as in Example I, but the charge receptor received no plasma treatment. When tested for charge transfer efficiency as in Example I, only 1% of the electrostatic charge transferred and no resolution figure could be read.

(c) On a third pair of similarly prepared charge donor and charge receptor samples, the charge donor received no plasma treatment, but the charge receptor was treated with oxygen plasma as in Example I. When tested for charge transfer efficiency, as in Example I, about 60% of the electrostatic charge transferred and the resolution of the developed image was about 130 lp/mm.

From the foregoing results, it can be seen that plasma treatment of the receptor is more important than similar treatment of the donor.

EXAMPLE III

This example demonstrates the use of a plasma treated photoconductor with a receptor containing a multitude of copper conductivity sites. The receptor was prepared in accordance with the method described in U.S. Pat. No. 4,454,186.

A charge receptor and a charge donor were prepared and treated as in Example I; however, in this example, treatment involved copper deposition onto the charge receptor by removing the polyester sheets covering the aluminum electrodes and using a copper electrode as the driven electrode.

The foregoing charge receptor composite was centrally placed on the aluminum anode with the dielectric layer facing the cathode. The system was then evacuated to about $1\times10^{-5}$ torr, oxygen gas introduced through a needle valve, and an equilibrium pressure in the range of $5\times10^{-4}$ torr to $8\times10^{-4}$ torr was maintained as oxygen was continuously introduced and pumped through the system.

With a shutter shielding the anode and composite structure thereon, R.F. energy source was capacitively coupled to the cathode, initiating a plasma. The energy input was increased until a cathode power density of 0.38 watts/cm$^2$ was reached, thus causing copper to be sputtered from the cathode and deposited on the shutter. This cathode cleaning operation was carried on for about ten minutes to assure a consistent sputtering surface. The cathode power was then reduced to 0.15 watts/cm$^2$ and the sputtering rate was allowed to become constant as determined by a quartz crystal monitor. A typical sputtering rate was nominally 0.1 nm/60 seconds. The shutter was then opened and the reactive sputter deposition of copper metal onto the dielectric layer was continued for about 60 seconds. Reflected power was less than 2 percent. In 60 seconds, the average film thickness was, therefore, approximately 0.1 nm. A charge receptor surface consisting of copper or copper oxide sites having a median size of about 7 nm and an average spacing of about 20 nm was thus formed.

When the imagewise exposure, electrostatic charge image transfer, and transferred charge development were carried out as in Example I, 57% of the electrostatic charge was transferred and the resolution of the developed image was about 170 lp/mm.

EXAMPLE IV

This example demonstrates the use of a plasma treated charge receptor and a donor containing a multitude of copper conductivity sites. The donor was prepared in accordance with the method described in U.S. Pat. No. 4,454,186.

A charge receptor and a charge donor were prepared as in Example I; however, in this example, plasma treatment of the charge donor involved copper deposition as described in Example III, and the charge receptor received oxygen plasma treatment as described in Example I.

When the image-wise exposure, electrostatic charge image transfer, and transferred charge development were carried out as in Example I, 59% of the electrostatic charge transferred and the resolution of the developed image was about 130 lp/mm.

EXAMPLE V

This example demonstrates the usefulness of gases other than oxygen as plasma media.

A charge receptor and a charge donor were prepared as in Example I. Electrostatic charge image patterns were generated, transferred, and developed as in Example I, except that the gas used was argon and the treatment was conducted for 78 seconds at 0.038 w/cm$^2$. Analysis of the receptor after argon plasma treatment revealed a surface with 76.5% carbon, 22.0% oxygen, and 1.5% nitrogen apportioned in the following manner:

$C_a=55.3\%$
$C_i=23.7\%$
$C_c=7.5\%$
$C_j=8.5\%$

An electrostatic charge transfer efficiency of 22% was observed and resolution of the developed image was greater than 150 lp/mm.

EXAMPLE VI

This example demonstrates the effect of treating both charge donor and charge receptor with an argon plasma medium.

A charge donor and charge receptor were prepared as in Example V; however, the charge receptor was not plasma treated. When the image-wise exposure, electrostatic charge transfer, and transferred charge development were carried out as in Example I, only 1% of the electrostatic charge transferred and the resolution could not be determined.

The preparation and treatment were repeated except that the carge receptor received argon plasma treatment as in Example V, and the charge donor was left untreated. Transfer efficiency was 17% and resolution of the developed image was 150 lp/mm.

EXAMPLE VII

A charge donor and a charge receptor were prepared as in Example IV with the exception that argon was used in place of oxygen for plasma treatment of the receptor sheet.

The preparation was repeated but with argon plasma treatment ($Cu/O_2$) of the charge receptor. The two pairs of samples were tested by image-wise exposure, electrostatic charge transfer and transferred charge development as in Example I. The following results were obtained.

| | Plasma Treatment | | Transfer Efficiency | Resolving Power |
|---|---|---|---|---|
| | Donor | Receptor | (%) | (lp/mm) |
| First pair samples | $Cu/O_2$ | Ar | 8 | 150 |
| Second pair samples | Ar | $Cu/O_2$ | 42 | 170 |

EXAMPLE VIII

This example demonstrates the usefulness of dielectrics other than polyester (Vitel ® PE200).

Electrostatic charge-image patterns were generated, transferred, and developed as in Example I with charge receptors prepared and treated as in Example I (oxygen plasma), II(a) (untreated), and V (argon plasma) with the exception that polystyrene (Aldrich), polymethylmethacrylate (Elvacite ® 2010), polycarbonate (Merlon ® 700), and polyvinyl butyral (Butvar ® B-76) dielectric coatings were used in place of polyester (Vitel ® PE200) as the charge receptor dielectric.

Charge transfer efficiencies ranged from 16 to 60% with resolution of the developed images being greater than 150 lp/mm.

TABLE IV

| Dielectric Film | Plasma Treatment | $\eta$ | Resolution (1 p/mm) |
|---|---|---|---|
| Polyester | Untreated | 0.118 | 108 |
| (Vitel ® PE200) | Oxygen | 0.374 | 228 |
| | Argon | 0.514 | 228 |
| Polystyrene | Untreated | 0.009 | 0 |
| (Aldrich) | Oxygen | 0.459 | 170 |
| | Argon | 0.028 | 170 |
| Polymethylmethacrylate | Untreated | 0.147 | 0 |
| (Elvacite ® 2010) | Oxygen | 0.613 | 216 |
| | Argon | 0.356 | 216 |
| Polycarbonate | Untreated | 0.094 | 0 |

TABLE IV-continued

| Dielectric Film | Plasma Treatment | η | Resolution (1 p/mm) |
|---|---|---|---|
| (Merlon ® 700) | Oxygen | 0.680 | 170 |
| | Argon | 0.156 | 170 |
| Polyvinylbutyral | Untreated | — | — |
| (Butvar ® 76) | Oxygen | 0.255 | 151 |
| | Argon | 0.282 | 151 |

EXAMPLE IX

This example demonstrates a means for providing high speed transfer accompanied by high efficiency.

Electrostatic charge image patterns were generated as in Example IV, i.e., donor treated in $Cu/O_2$ plasma and receptor treated in oxygen plasma. Transfer of the electrostatic charge image pattern was accomplished using a roller transfer mechanism as described below:

As in Example I the charge donor was attached to a grounded aluminum platform. The charge receptor was placed on a roller consisting of a central metal axle, a concentric hard rubber layer, and a concentric thin metal layer. The rubber layer sandwiched between the axle and the outer metal layer flexed to provide uniform contact, and the metal layer provided a smooth stable surface to help eliminate motion of the charge receptor/charge donor interface during transfer. Transfer was effected by wrapping the charge receptor around the roller and applying pressure to the roller to bring the charge receptor in intimate contact with the charge donor on the aluminum plate. Transfer of the complete image was accomplished by sliding the charge donor/-backing plate over the roller bringing the entire electrostatic charge pattern image in contact with the charge receptor. Since the roller was free to roll there was a one-to-one transfer of the image to the receptor. Contact time at the nip during transfer was calculated by measuring the nip width and the horizontal velocity of the charge donor/aluminum backing plate. Measurement of the surface potential on the charge receptor after separation from the charge donor indicated about 57% of the electrostatic charge had transferred even at contact times during transfer down to 0.002 seconds.

EXAMPLE X

A charge receptor and a charge donor were prepared as in Example I; however, the charge receptor was treated in copper/oxygen plasma as in Example III and the charge donor was treated in oxygen plasma as in Example I. When the image-wise exposure and electrostatic charge image transfer were carried out as in Example IX, only about 30% of the electrostatic charge transferred, even at contact times of greater than 0.05 seconds. At contact times shorter than 0.05 seconds, the percent of charge transferred dropped off dramatically.

EXAMPLE XI

A charge receptor and a charge donor were prepared as in Example I, except the charge donor was an inorganic SeTe construction comprising a 40 μm thick layer of 95% selenium/5% tellurium on an aluminum substrate. Measurement of the surface potential on the charge receptor after separation from the charge donor indicated about 25% of the electrostatic charge had transferred. Development of the resulting charge pattern as in Example I gave a resolution of 130 lp/mm.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A charge transfer medium comprising a conductive support layer, and overlying said layer, a photoconductive-insulative layer, wherein the atomic percent of oxygen in the surface of said photoconductive-insulative layer exceeds the atomic percent of oxygen in the bulk of said photoconductive-insulative layer by at least four atomic percent, the surface of said photoconductive-insulative layer having a surface roughness no greater than 0.01 micrometer.

2. The medium of claim 1 wherein said surface of said photoconductive-insulative layer comprises as shown by XPS four different types of surface carbon species designated $C_a$, $C_c$, $C_i$, and $C_j$ each type present being in the range of 0.2 to 75 percent of total carbon.

3. The medium of claim 2 wherein the four different types of surface carbon species designated $C_a$, $C_c$, $C_i$, and $C_j$ are present in the range of 20 to 70 percent, 1 to 15 percent, 3 to 60 percent, and 3 to 20 percent, respectively.

4. The medium of claim 2, wherein the four different types of surface carbon species designated $C_a$, $C_c$, $C_i$, and $C_j$ are present in the range of 55 to 70, 5 to 15, 5 to 25, and 5 to 20 percents, respectively.

5. The medium of claim 1 wherein said photoconductive-insulative layer is an organic photoconductive-insulative material.

6. A charge transfer medium comprising a conductive support layer, and overlying said layer, a dielectric layer, wherein the atomic percent of oxygen in the surface of said dielectric layer exceeds the atomic percent of oxygen in the bulk of said dielectric layer by at least four atomic percent, the surface of said dielectric layer having a surface roughness no greater than 0.01 micrometer.

7. The medium of claim 6 wherein said surface of said dielectric layer comprises as shown by XPS four different types of surface carbon species designated $C_a$, $C_c$, $C_i$, and $C_j$ each type present being in the range of 0.2 to 75 percent of total carbon.

8. The medium of claim 7 wherein the four different types of surface carbon species designated $C_a$, $C_c$, $C_i$, and $C_j$ are present in the range of 20 to 70 percent, 1 to 15 percent, 3 to 60 precent, and 3 to 20 percent, respectively.

9. The medium of claim 7 wherein the four different types of surface carbon species designated $C_a$, $C_c$, $C_i$, and $C_j$ are present in the range of 55 to 70, 5 to 15, 5 to 25, and 5 to 20 percents, respectively.

10. The medium of claim 6 wherein said dielectric layer is an organic polymeric material.

11. A method for making an electrostatic charge transfer medium comprising the steps of:

(1) providing an article comprising a conductive support layer, and overlying said layer, a photoconductive-insulative layer, (2) subjecting the major surface of said photoconductive-insulative layer not in contact with the conductive support layer to plasma treatment so as to increase the atomic percent of oxygen in the surface of said photoconductive-insulative layer so subjected by at least four atomic percent, said plasma treatment resulting in roughness of said photoconductive-insulative layer not exceeding 0.01 micrometer.

12. A method for making an electrostatic charge transfer medium comprising the steps of:

(1) providing an article comprising a conductive support layer, and overlying said layer, a dielectric layer, (2) subjecting the major surface of said dielectric layer not in contact with the conductive support layer to plasma treatment so as to increase the atomic percent of oxygen in the surface of said dielectric layer so subjected by at least four atomic percent, said plasma treatment resulting in roughness of said photoconductive-insulative layer not exceeding 0.01 micrometer.

* * * * *

UNITED STATES PATENT AND TRADEMARK OFFICE

CERTIFICATE OF CORRECTION

PATENT NO. : 4,569,895

DATED : February 11, 1986

INVENTOR(S) : Stephen J. Willett, Hsin H. Chou, Carol E. Hendrickson, and William A. Hendrickson It is certified that error appears in the above-identified patent and that said Letters Patent is hereby corrected as shown below:

Col. 2, line 11 "photoconductive-insulative layer not" should read --photoconductive-insulative layer or dielectric layer not--.

Col. 3, line 26 "inventioon" should read --invention--.

Col. 3, line 32 "photoconductives-" should read --photoconductive---.

Col. 4, line 3 "chage" should read --charge--.

Col. 12, line 28 "treatment ($Cu/O_2$)" should read --treatment of the charge donor and copper/oxygen plasma treatment ($Cu/O_2$)--.

Col. 12, line 47 "Example" should read --Examples--.

Col. 4, line 4 "photoconductive-conductive layer" should read --photoconductive-insulative layer--.

Signed and Sealed this

*First* Day of *July 1986*

[SEAL]

*Attest:*

DONALD J. QUIGG

*Attesting Officer*

*Commissioner of Patents and Trademarks*